US006810643B1

(12) United States Patent
Gecic et al.

(10) Patent No.: US 6,810,643 B1
(45) Date of Patent: Nov. 2, 2004

(54) METHOD OF ROLL PACKING COMPRESSIBLE MATERIALS

(75) Inventors: Josip Gecic, Koprivnica (HR); Niels S. Mossbeck, Carthage, MI (US); Thomas J. Wells, Carthage, MI (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/419,644

(22) Filed: Apr. 21, 2003

(51) Int. Cl.[7] ..... B65B 63/04

(52) U.S. Cl. ..... 53/430; 53/114; 53/119; 53/439; 53/529

(58) Field of Search ..... 53/430, 435, 436, 53/438, 439, 114, 116, 118, 119, 513, 520, 526, 528, 529, 530, 541; 242/571.6, 571.4, 583, 571, 573.8, 590, 596.4

(56) References Cited

U.S. PATENT DOCUMENTS

| | | | | | |
|---|---|---|---|---|---|
| 2,114,008 | A | | 4/1938 | Wunderlich | |
| 2,311,383 | A | | 9/1943 | Hardenberg | |
| 3,122,089 | A | | 2/1964 | Sinclair | |
| 3,129,658 | A | | 4/1964 | Valente | |
| 3,270,976 | A | | 9/1966 | Smith | |
| 3,521,424 | A | | 7/1970 | Wirfel | |
| 3,660,958 | A | * | 5/1972 | Garrison | 53/399 |
| 3,927,504 | A | | 12/1975 | Forrister | |
| 3,964,232 | A | | 6/1976 | Bender et al. | |
| 4,109,443 | A | | 8/1978 | Findlay | |
| 4,365,767 | A | * | 12/1982 | Benthimere | 242/534.2 |
| 4,377,262 | A | | 3/1983 | Zajac | |
| 4,507,947 | A | | 4/1985 | Stanley | |
| 4,532,750 | A | | 8/1985 | Meier | |
| 4,550,550 | A | | 11/1985 | Scott | |
| 4,711,067 | A | * | 12/1987 | Magni | 53/439 |
| 4,775,111 | A | | 10/1988 | Kalin | |
| 4,967,536 | A | | 11/1990 | Reist | |
| 5,101,610 | A | | 4/1992 | Honegger | |
| 5,121,584 | A | | 6/1992 | Suter | |
| 5,765,343 | A | | 6/1998 | Whittaker | |
| 5,934,041 | A | | 8/1999 | Rudolf et al. | |
| 6,098,378 | A | | 8/2000 | Wyatt | |
| 6,298,510 | B1 | * | 10/2001 | Mossbeck | 5/655.7 |
| 6,357,209 | B1 | | 3/2002 | Mossbeck et al. | |
| 6,467,239 | B2 | | 10/2002 | Mossbeck et al. | |

OTHER PUBLICATIONS

U.S. patent application Publication No. US2003/O074863, Mossbeck.

U.S. patent application Publication No. US 2003/O074864, Gecic.

* cited by examiner

*Primary Examiner*—Stephen F. Gerrity
*Assistant Examiner*—Thanh Truong
(74) *Attorney, Agent, or Firm*—Wood, Herron & Evans, LLP

(57) ABSTRACT

A method of roll packing a variety of compressible materials is provided which prevents the rotatable mandrel about which the materials are rolled from radially collapsing. The method further provides for easy removal of the roll packed material without tearing or telescoping of the material. One embodiment of the present invention provides for wrapping a corrugated material around the rotatable mandrel prior to the compressible material being wrapped around the mandrel. In another embodiment, roll-packing material is laminated prior to being wound upon the mandrel before the compressible material is wrapped around the mandrel.

19 Claims, 6 Drawing Sheets

METHOD OF ROLL PACKING COMPRESSIBLE MATERIALS

FIELD OF THE INVENTION

This invention relates to the packaging of compressible materials such as foam, spring assemblies, mattresses and the like, and is more particularly directed to method of roll packing such compressible materials.

BACKGROUND OF THE INVENTION

Conventional packaging and transportation of compressible materials such as finished mattresses, as well as foam or spring assemblies used in the manufacture of mattress products, generally involves handling of the materials in an uncompressed state. As such, the shipping and storage of the materials requires much more space than would be required if the materials were provided in a compressed state. To improve the efficiency of shipping and storage, foam mattress cores have been packaged in a compressed state by flattening the foam and sealing it in an evacuated bag. See, for example, U.S. Pat. No. 4,711,067 to Magni. This method of packaging foam cores, however, is not useful in packaging spring assemblies. In addition, storage and transportation efficiencies of the foam could be further improved by packaging the flattened cores into a tight roll.

Roll packing generally involves winding-up a desired material to form a roll and then securing the roll to prevent uncoiling of the roll during handling. In the case of compressible materials such as mattresses and foam or spring cores, it is often desired to compress the materials during the roll packing process to obtain a more dense and compact roll. Various devices have been used to achieve compression of roll packed materials. U.S. Pat. No. 3,927,504 to Forrister discloses an apparatus for rolling resilient foamed sheet material without the use of a mandrel. This machine is not useful for packaging spring assemblies and does not have the capability to package multiple units of a compressible material into a large roll. The device further does not provide for packaging a compressible material with a barrier layer between successive turns of the roll, which barrier layer is desirable to prevent adhesion between successive layers of foam.

Some roll packing systems include a mandrel for facilitating the winding of the material. For example, U.S. Pat. No. 2,114,008 to Wunderlich discloses a spring packing machine having a radially collapsible arbor for use in roll packing spring assemblies. A barrier layer between successive turns of the roll keeps the spring assemblies separate and permits easy removal of a single assembly from the roll. However, this machine is not useful for roll packing foam material due to the presence of a pressure bar which would tend to snag a compressed foam as it passed beneath. The disclosed machine also has other drawbacks. For example, to remove a finished roll, the arbor must be removed from the machine and collars must be adjusted to collapse the arbor so that the roll can be taken off the arbor. The arbor must then be replaced in the machine before another roll can be formed. Operation of the machine is thus very labor intensive and ergonomically inefficient.

The roll packing of spring assemblies, foam cores or other compressible materials onto mandrels has heretofore been a problem because the compressible material does not slide easily off of the mandrel after being rolled up. Difficulties in removing the compressible material from the mandrel are due to the material's high friction coefficient in combination with the high compression force against the mandrel that is created when the compressed material is wound around the mandrel. When a spring or foam core is compressed onto a mandrel, the material has a natural tendency to want to expand in both radial directions, i.e., to expand radially outward from the mandrel and radially inward to the mandrel. As a result of the inward compressive force, the compressible material essentially sticks to the mandrel.

Consequently, attempting to withdraw the roll from the mandrel may damage the first few layers of the roll or cause undesirable telescoping or tearing of the rolled material as it is removed from the mandrel. Additionally, the center of the roll may implode once the roll is removed from the mandrel, causing the layers proximate the center of the roll to deform or tear.

There is thus a need for a method of efficiently roll packing compressible material such as foam or spring cores so that the roll may removed from the mandrel without damaging the rolled material or causing undesirable telescoping or tearing of the rolled material.

SUMMARY OF THE INVENTION

The present invention provides a method of roll packing a variety of compressible materials such as foam cores, spring assemblies, and fiber materials used in the manufacture of bedding or seating products, as well as finished mattresses. The machine preferably has a rotatable mandrel with collapsible cleats which permits finished roll packed materials to be easily removed from the machine by sliding the roll off of the mandrel. This type of mandrel, when used in conjunction with the present invention, permits rolled materials to be removed without any telescoping or tearing of the materials which is usually caused by binding of the roll packed material on the mandrel. However, the methods of the present invention may be used with other types of mandrel including those without retractable cleats. The present invention is especially useful in roll packing foam materials which are highly susceptible to binding against a mandrel. The methods of the present invention further permit roll packing practically any compressible material, even materials as diverse as coiled spring assemblies for mattresses and foam cores.

In accordance with the present invention, a method is provided which employs a mandrel having collapsible cleats for winding compressible materials to be roll packed. A feed table may be provided upstream of the mandrel to support and direct the compressible material to the mandrel. At least one compression roller associated with the mandrel is used to compress in-fed compressible materials in a nip between the compression roller and the mandrel as the material is being wound upon the mandrel. At least one compression roller is adjustable to vary the spacing between the mandrel and the compression roller so that the amount of compression for the in-fed materials can be varied accordingly. The apparatus used to practice of the present invention may be identical to or similar to the apparatus disclosed in applicant's U.S. patent application Ser. No. 10/066,905, filed on Oct. 22, 2001 entitled APPARATUS AND METHOD FOR ROLL PACKING COMPRESSIBLE MATERIALS, which is fully incorporated by reference herein. However, any other apparatus may be used to practice the present invention. The invention of this application is not intended to limit the apparatus used to employ the methods of the present invention.

In further accordance with the present invention, a method for roll packing various compressible materials includes the steps of providing a mandrel rotatable about an axis and a compression roller, directing in-fed compressible materials between the mandrel and compression roller, adjusting the spacing between the mandrel and compression roller, winding the compressible material around the mandrel, stopping the mandrel when a desired amount of in-fed material has been wound upon the mandrel, and removing the roll packed material from the mandrel.

According to one aspect of the present invention, roll packing material such as paper is wrapped around the mandrel before a sheet of corrugated material is fed to the mandrel. Rotation of the mandrel winds the corrugated material around the mandrel at least one revolution. The corrugated material is then secured to itself to form a corrugated sleeve or core around the mandrel. Preferably, the corrugations of the corrugated material are oriented generally perpendicular to the rotational axis of the mandrel. A compressible material such as a continuous web of foam or other compressible material or a series of spring assemblies is fed to the mandrel along with the roll packing material. Rotation of the mandrel causes the compressible material to wind around the mandrel along with the roll packing material which forms a barrier between layers of the compressible material. When a roll of the desired size is achieved, rotation of the mandrel is stopped and the webs of roll packing material and/or compressible material cut. The roll packing material is then wrapped at least once more around the roll and secured to prevent the roll from expanding. The roll is then removed from the mandrel without the roll imploding, thereby damaging the inner layers of the roll. The corrugated sleeve or core provides a protective layer which prevents the roll from imploding.

According to another aspect of the present invention, a sheet of stiffening material, corrugated or not, is wrapped around the mandrel by rotation of the mandrel. The stiffening material may be secured to itself or to the mandrel; either way, it forms a sleeve or core around the mandrel which prevents the roll from imploding when the roll is removed from the mandrel and thereafter. Next, a compressible material such as a continuous web of foam, a series of spring assemblies or mattresses is fed to into the nip along with roll packing material. Rotation of the mandrel causes the compressible material to wind around the mandrel outside the sleeve or core along with the roll packing material which forms a barrier between layers of the compressible material. When a roll of the desired size is achieved, rotation of the mandrel is stopped and the webs of roll packing material and/or compressible material cut. The roll packing material may then be wrapped at least once more around the roll and secured to prevent the roll from expanding. The roll is then removed from the mandrel without the roll imploding, thereby damaging the inner layers of the roll.

According to another aspect of the present invention, roll packing material is wrapped once around the mandrel to cover the mandrel. Adhesive or other similar materials are then applied to the roll packing material as the roll packing material is wrapped around the mandrel. As the roll packing material is applied over the existing layers of roll packing material by rotation of the mandrel, the adhesive between the layers of roll packing material drys. The result is a laminated sleeve or core immediately adjacent the mandrel. Once a sufficient number of layers of roll packing material have been wrapped around the mandrel, application of the adhesive is stopped. However, the roll packing material continues to be wrapped around the mandrel along with the compressible material. A compressible material such as a continuous web of foam or a series of spring assemblies is fed to the mandrel along with the roll packing material. Rotation of the mandrel causes the compressible material to wind around the mandrel along with the roll packing material which forms a barrier between layers of the compressible material. When a roll of the desired size is achieved, rotation of the mandrel is stopped and the webs of roll packing material and/or compressible material cut. The roll packing material is then wrapped at least once more around the roll and secured to prevent the roll from expanding. The roll including the sleeve or core is then removed from the mandrel without the roll imploding, thereby damaging the inner layers of the roll. The laminated sleeve or core provides a protective layer which prevents the roll from imploding.

Accordingly, the invention provides a method for roll packing a variety of compressible materials and which is preferably used in conjunction with a mandrel having collapsible cleats that facilitates the easy removal of finished rolls without tearing, telescoping, or otherwise damaging the roll packed material. These and other objects and advantages of the present invention shall be made apparent from the accompanying drawings and description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

An apparatus and methods are provided for roll packing compressible materials about a rotatable mandrel so that a completed roll may be removed from the mandrel in a simple and efficient manner without damaging the materials, and wherein the materials can be stored and shipped in a compact state. The methods of the present invention will be described and understood by a description of an exemplary apparatus. However, the methods of the present invention may be used on any suitable apparatus.

Figure 1:
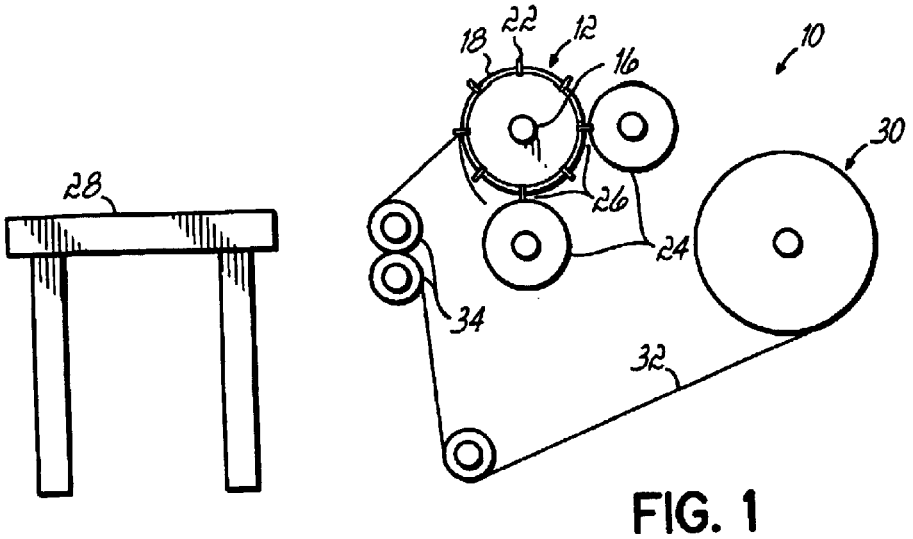
FIG. 1 is a schematic side elevational view showing a roll packing apparatus for use in practicing one embodiment of the method of the present invention and illustrates the step of securing roll-packing material to a rotatable mandrel.

With reference to FIG. 1, there is shown an illustration of one embodiment of roll packing apparatus 10 incorporating the principles of the present invention. The apparatus 10 includes a rotatable mandrel 12 for receiving in-fed compressible materials 14 and winding them into a roll. Although the compressible materials 14 are illustrated as being spring units, the compressible material may be foam or any other type of compressible material.

Figure 9:
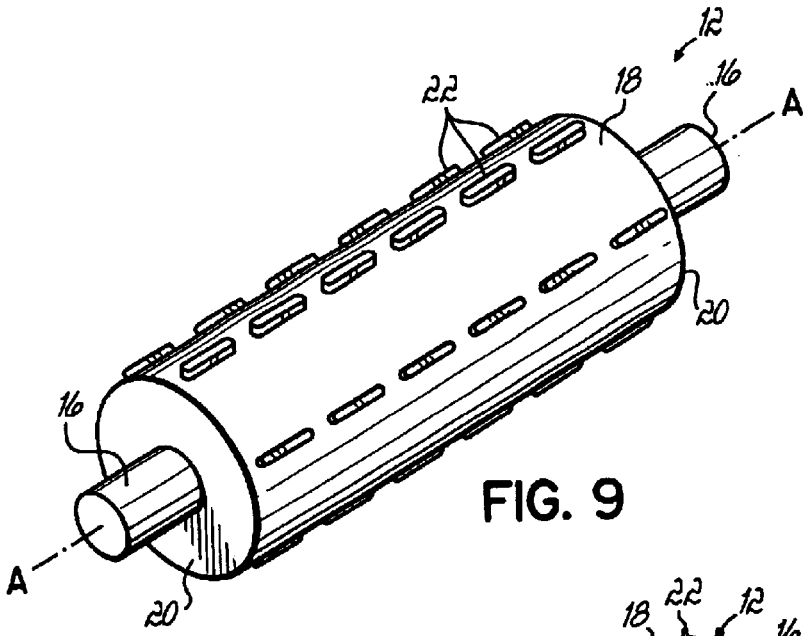
FIG. 9 is a perspective view of a mandrel used in accordance with the present invention.
Figure 9A:
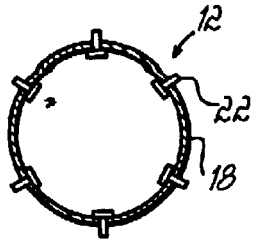
FIG. 9A is an end view of the mandrel of FIG. 9 showing the cleats in an expanded position.
Figure 9B:
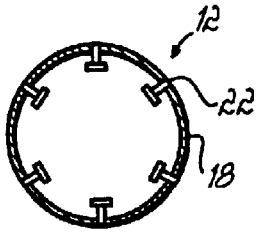
FIG. 9B is an end view of the mandrel of FIG. 9 showing the cleats in a collapsed position.

As best illustrated in FIG. 9, the mandrel 12 rotates about a rotational axis A and is fixed to a shaft 16 that is driven by a driving mechanism (not shown). The mandrel 12 is generally cylindrical in shape and has an outer surface 18 and a pair of end surfaces 20. The mandrel 12 has a plurality of aligned, spaced cleats 22 which are movable between a first expanded position illustrated in FIG. 9A and a second collapsed position illustrated in FIG. 9B. The cleats 22 may be moved between positions either mechanically, via air pressure, or via any other means. As seen in the drawings of this application, the cleats 22 are extended in their expanded position while the mandrel 12 is being rotated and collapsed radially inwardly into their collapsed position prior to a completed roll being removed. In accordance with the methods of the present invention, when the cleats 22 are in the collapsed position shown in FIG. 9B, a completed roll may be easily removed from the mandrel 12 without tearing, telescoping or otherwise damaging the compressible material which is roll-packed.

A pair of compression rollers 24 are located proximate the mandrel 12. Each compression roller has an axis generally parallel the rotational axis A of the mandrel 12. The relative positions of the compression rollers 24 and mandrel 12 may be adjusted to either increase or decrease the spacing 26 between their respective outer surfaces. The spacing 26 between the mandrel 12 and the compression rollers 24 determines the amount of compression to be applied to the compressible material 14. A feed table 28 may be located upstream of the mandrel 12 and compression rollers 24. Although two compression rollers 24 are illustrated and described, any number of compression rollers including only one may be used in accordance with the methods of the present invention. Although a feed table 28 is illustrated and described any other support such as a conveyor may be used to feed compressible materials 14 into the spacing or nip 26 between one of the compression rollers 24 and the mandrel 12.

Referring to FIGS. 1–8, one embodiment of the method of the present invention is illustrated. Referring to FIG. 1, a supply roll 30 of roll packing material 32 such as paper is provided. The roll packing material 32 may alternatively be stacked or stored in other manner without departing from the spirit of the present invention. The roll packaging material 32 is wrapped around guide rollers 34 and attached to the outer surface 18 of the mandrel 12. As seen in FIGS. 1–7, the retractable cleats 22 of the mandrel 12 are extended in the expanded position.

Figure 2:
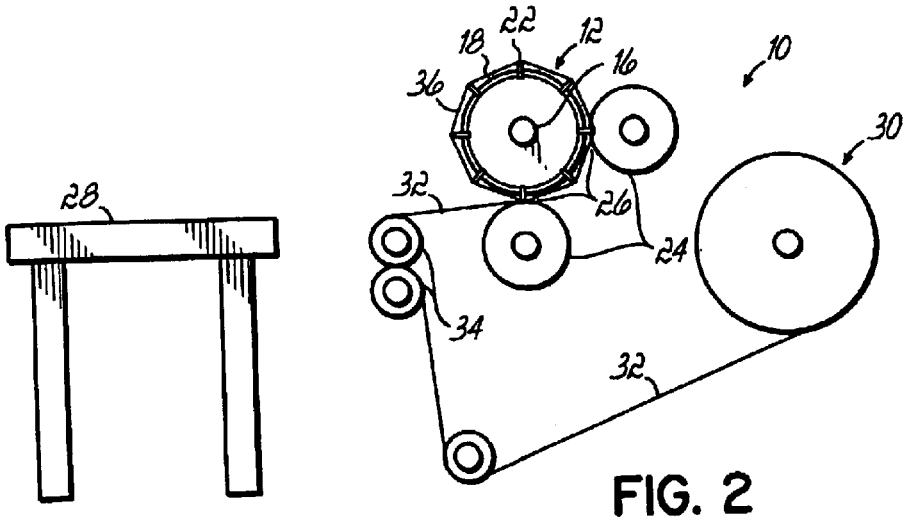
FIG. 2 is a schematic side elevational view of the roll packing apparatus of FIG. 1 and illustrates the step of wrapping roll-packing material around the rotatable mandrel.

Referring to FIG. 2, the mandrel 12 is rotated, thereby wrapping the roll packing material 24 around the mandrel 12. Due to the expanded cleats 22 of the mandrel 12, the roll packing material 32 assumes a multi-segmented form comprising multiple linear segments 36. The number of linear segments 36 depends on the number of rows of cleats 22 around the circumference of the mandrel 12. In this manner, the roll packing material 24 preferably does not directly contact the outer surface 18 of the mandrel 12, although it may do so without departing from the spirit of this invention.

Figure 3:
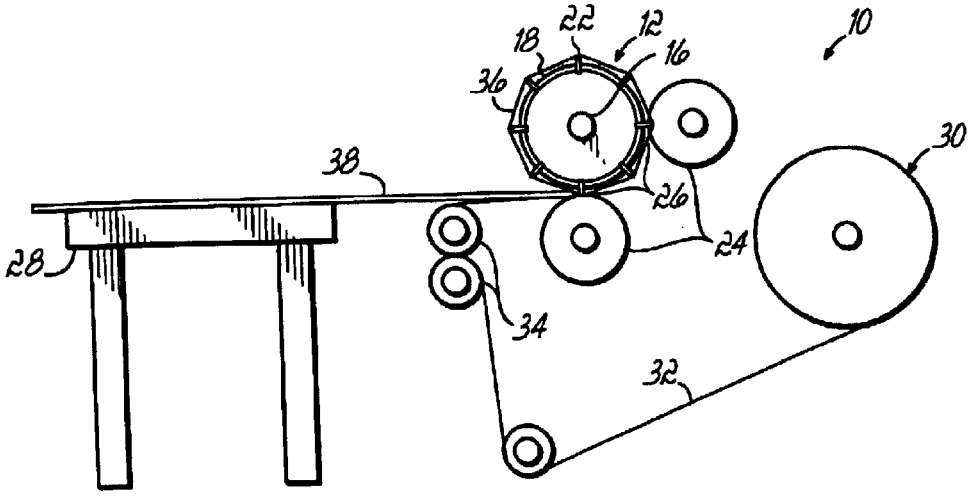
FIG. 3 is a schematic side elevational view of the roll packing apparatus of FIG. 1 and illustrates the step of feeding a sheet of corrugated material to the mandrel.
Figure 3A:
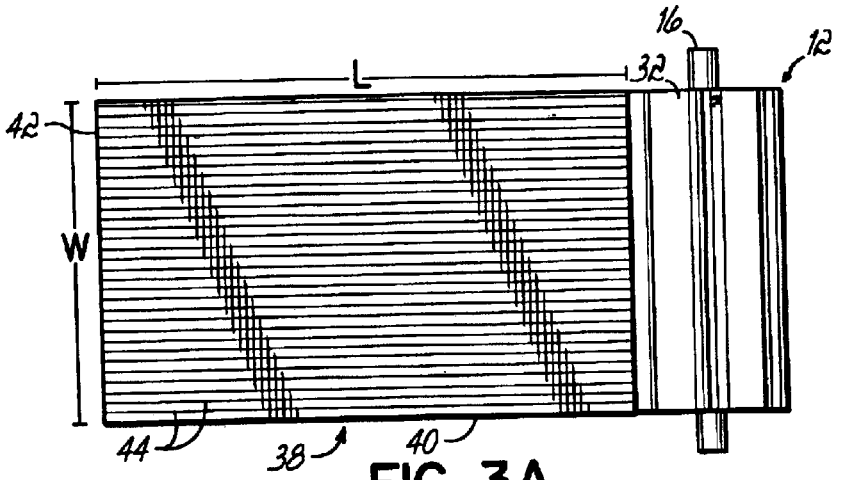
FIG. 3A is a schematic top plan view of the roll packing apparatus of FIG. 1 and illustrates the step of feeding a sheet of corrugated material to the mandrel.

Referring to FIGS. 3 and 3A, a sheet of corrugated material 38 supported by the feed table 28 is fed into the nip 26. The mandrel 12 is further rotated, thereby wrapping the corrugated material 38 around the mandrel 12. Again, due to the expanded cleats 22 of the mandrel 12, the corrugated material 38 forms a multi-segmented form like the roll packing material 24. As illustrated in FIG. 3A, the sheet of corrugated material 38 has side edges 40 defining a width W of the sheet, end edges 42 defining the length L of the sheet 38 and flutes or corrugations 44 extending parallel the side edges 40 or longitudinally. The sheet of corrugated material 38 is preferably oriented such that the corrugations 44 are generally perpendicular to the rotational axis A of the mandrel 12. However, the sheet of corrugated material 38 may be oriented in any other manner. When the sheet of corrugated material 38 is fed into the nip 26, one of the end edges 42 is introduced or fed into the nip 26 first.

Figure 4:
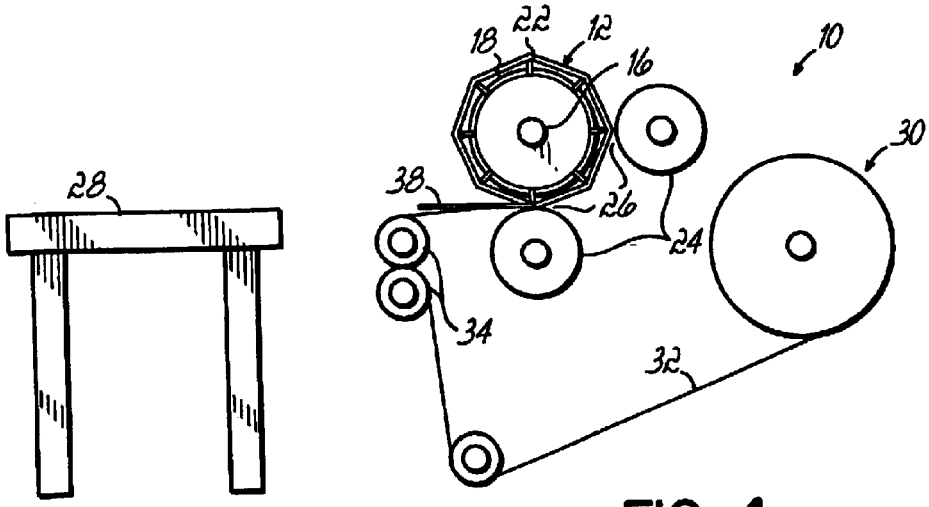
FIG. 4 is a schematic side elevational view of the roll packing apparatus of FIG. 1 and illustrates the step of wrapping the sheet of corrugated material around the mandrel.

As shown in FIG. 4, the next step in the process is further rotation of the mandrel 12 which causes the sheet of corrugated material 38 to wrap at least once around the mandrel 12. The sheet of corrugated material 38 is then wrapped over itself in an overlapped portion 48 and secured to itself either by adhesive, staples or other fasteners, thereby creating a sleeve, core or shell 50, shown in FIG. 5. Alternatively, the sheet of corrugated material 38 may be secured to the roll packing material 32 or the mandrel 12. The corrugated sleeve 50 has sufficient rigidity to prevent the finished roll pack from imploding while being removed from the mandrel or thereafter. As mentioned above, the present invention may also be practiced with non-corrugated material. Alternatively, the sleeve, core or shell 50 may be formed around the mandrel prior to the roll packing material 32 being wrapped around the mandrel. In this situation, the roll packing material 32 could be secured to the sleeve, core or shell 50 before further rotation of the mandrel wraps the roll packing material 32 around the sleeve 50.

Figure 5:
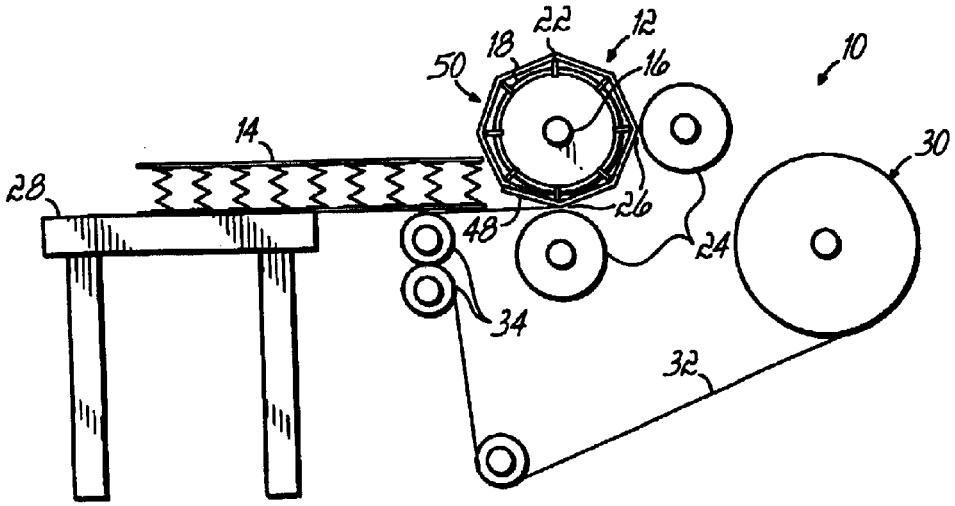
FIG. 5 is a schematic side elevational view of the roll packing apparatus of FIG. 1 and illustrates the step of feeding a compressible material to the mandrel.
Figure 6:
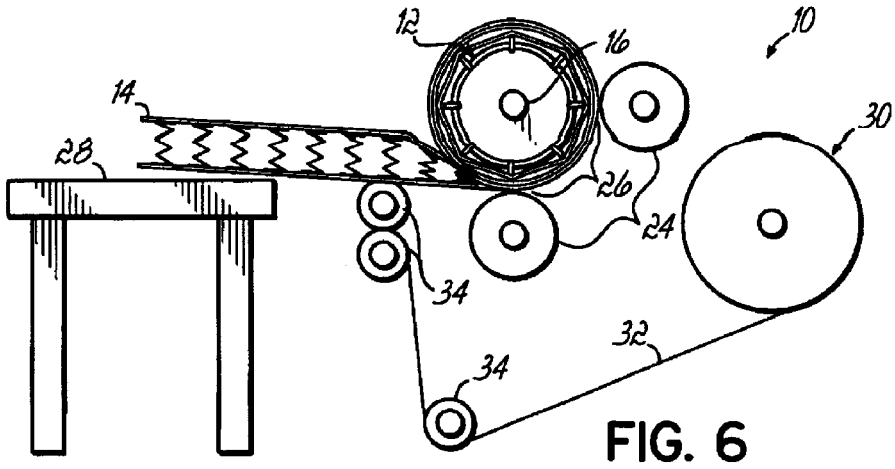
FIG. 6 is a schematic side elevational view of the roll packing apparatus of FIG. 1 and illustrates the step of compressing the compressible material.

FIG. 5 illustrates the step of feeding a compressible material, in this case a spring assembly 14 into the nip 26 between one of the compression rollers 24 and the mandrel 12 which is at this point surrounded with the corrugated shell 50. At the same time the compressible material 14 is being fed to the mandrel 12, the roll packing material 32 is being fed to the mandrel 12 underneath the compressible material 14. As shown in FIG. 6, the compressible material 14 is compressed as it passes between the compression rollers 24 and the mandrel 12.

Figure 7:
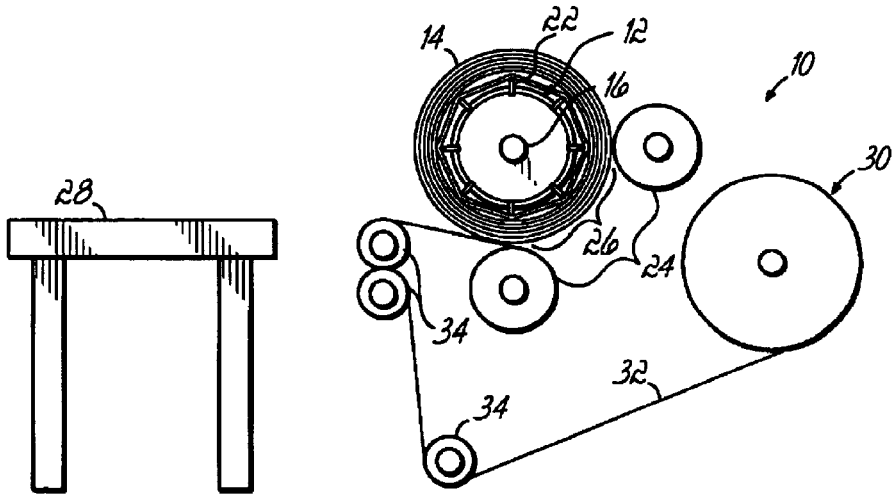
FIG. 7 is a schematic side elevational view of the roll packing apparatus of FIG. 1 and illustrates the step of wrapping the compressible material around the mandrel.
Figure 8:
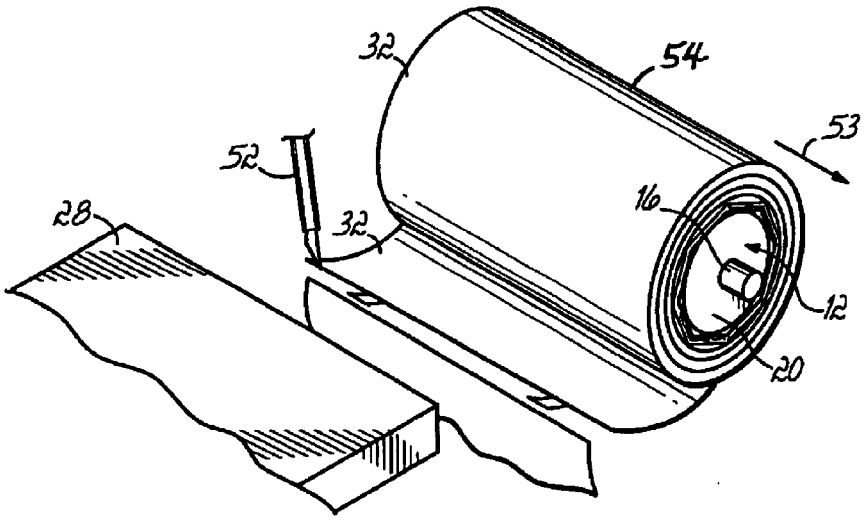
FIG. 8 is a perspective view of the stop of cutting the roll packing material to form a roll of the desired size.

FIG. 7 illustrates the step of stopping the compressible material 14 from being fed into the nip 26. Although the compressible material 14 is no longer being fed to the mandrel 12, the roll packing material 32 is being fed to the mandrel 12 at least one revolution around the mandrel. As shown in FIG. 8, the roll packing material 32 is cut with a knife or other suitable apparatus 52 and secured in order to contain the compressible material 14. The finished roll 54 is taken off the mandrel 12 as designated by arrow 53 in a manner such as that disclosed in U.S. patent application Ser. No. 10/066,905 once the cleats 22 of the mandrel 12 are moved to the collapsed position shown in FIG. 9B. However, the finished roll 54 may be removed from the mandrel 12 in any manner.

Figure 10:
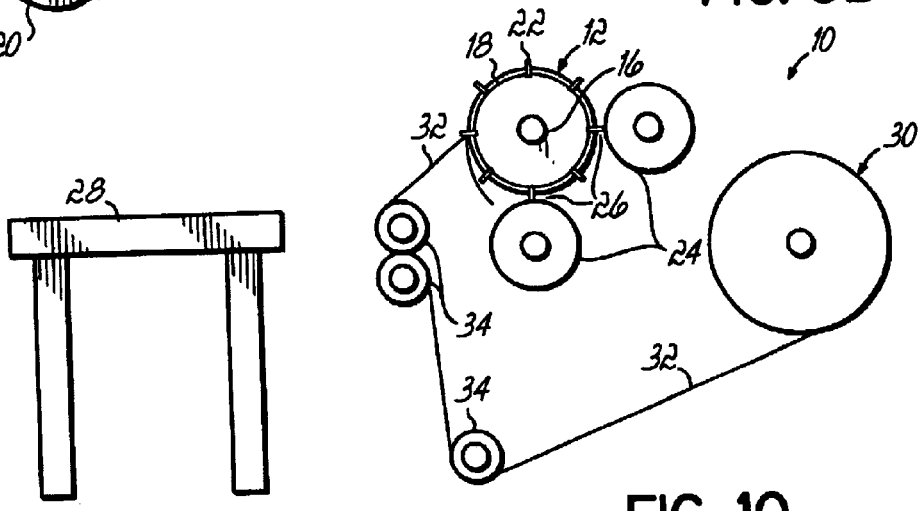
FIG. 10 is a schematic side elevational view showing a roll packing apparatus for use in practicing an alternative embodiment of the method of the present invention and illustrates the step of securing roll-packing material to a rotatable mandrel.

FIGS. 10–15 illustrate another preferred embodiment of the method of the present invention. Referring to FIG. 10, a supply roll 30 of roll packing material 32 such as paper is provided. The roll packing material 32 may alternatively be stacked or stored in other manner without departing from the spirit of the present invention. The roll packaging material 32 is wrapped around guide rollers 34 and attached to the outer surface 18 of the mandrel 12 in any suitable manner. The retractable cleats 22 of the mandrel 12 are extended in the expanded position.

Figure 11:
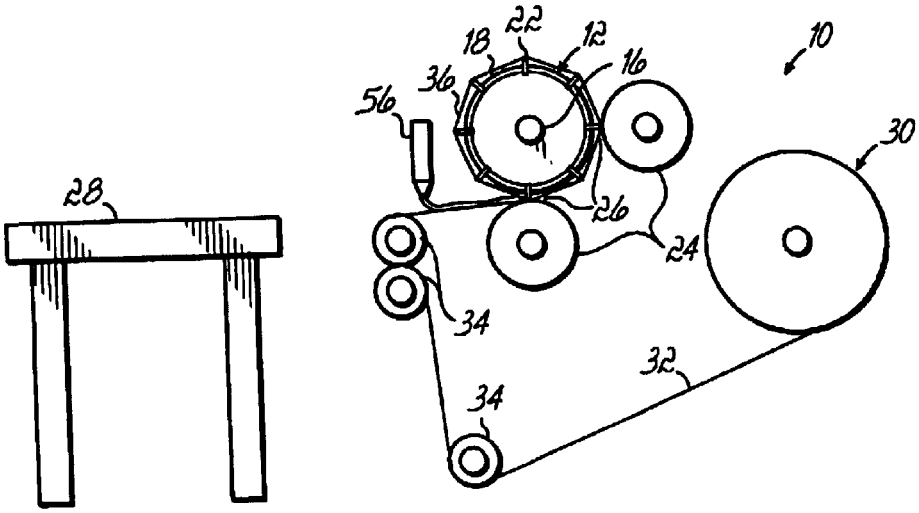
FIG. 11 is a schematic side elevational view of the roll packing apparatus of FIG. 10 and illustrates the step of wrapping roll-packing material around the mandrel.

Referring to FIG. 11, a dispensing apparatus 56 deposits adhesive or any other laminating material upon the roll packing material so that as the mandrel 12 is rotated, the roll packing material 32 is wrapped around the mandrel 12, the adhesive being sandwiched between layers of roll packing material. Due to the expanded cleats 22 of the mandrel 12, the roll packing material 32 assumes a multi-segmented form comprising multiple linear segments 36. The number of linear segments 36 depends on the number of rows of cleats 22 around the circumference of the mandrel 12. In this manner, the roll packing material 32 preferably does not directly contact the outer surface 18 of the mandrel 12, although it may do so.

Figure 12:
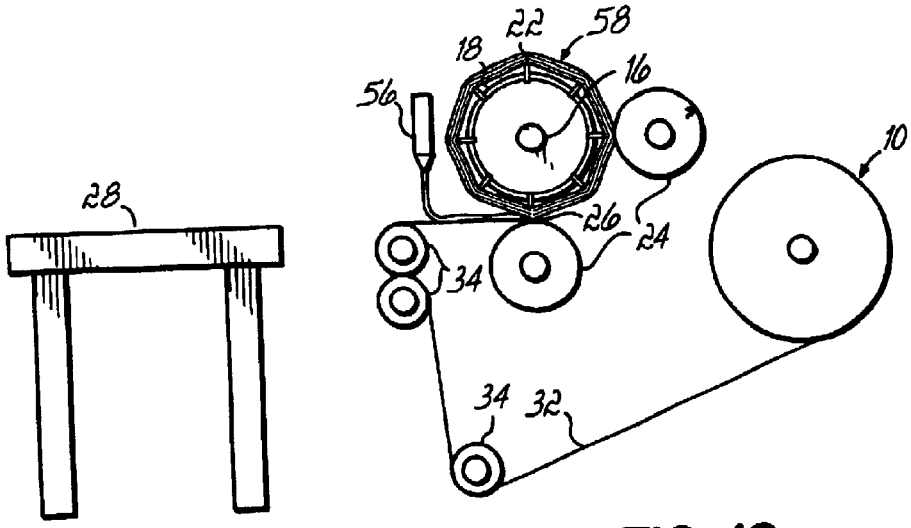
FIG. 12 is a schematic side elevational view of the roll packing apparatus of FIG. 10 and illustrates the step of wrapping roll-packing material with adhesive applied thereto around the mandrel.
Figure 13:
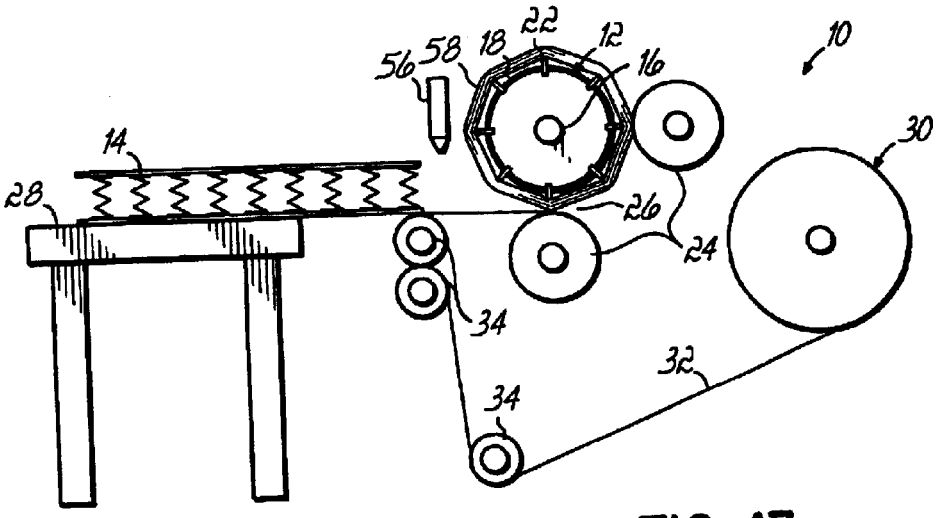
FIG. 13 is a schematic side elevational view of the roll packing apparatus of FIG. 10 and illustrates the step of stopping the application of adhesive to the roll packing material.

Referring to FIGS. 12 and 13, the mandrel 12 is further rotated, thereby wrapping the roll packing material 32 around the mandrel 12. Again, due to the expanded cleats 22 of the mandrel 12, the roll packing material 32 forms a multisegmented form. As shown in FIG. 12, the application of adhesive continues as the mandrel 12 is further rotated around the mandrel 12. The adhesive between the layers of roll packing material 32 is then allowed to dry or cure, thereby creating a core or shell 58, shown in FIG. 12. As shown in FIG. 13, the application of adhesive is stopped at a point, although the roll packing material 32 continues to be wrapped around the mandrel 12 upon further rotation of the mandrel.

Figure 14:
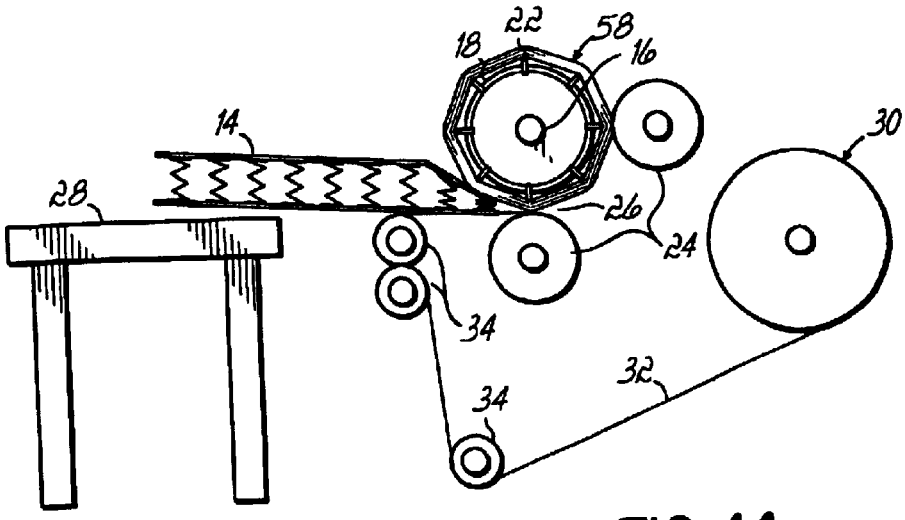
FIG. 14 is a schematic side elevational view of the roll packing apparatus of FIG. 10 and illustrates the step of feeding a compressible material to the mandrel.

FIG. 13 illustrates the step of feeding a compressible material, in this case a spring assembly 14 into the nip 26 between one of the compression rollers 24 and the mandrel 12 which is at this point surrounded with the protective sleeve, core or shell 58. The sleeve 58 is a laminated sleeve in this embodiment of the present invention and has sufficient rigidity to prevent the finished roll pack from imploding while being removed from the mandrel or thereafter. At the same time the compressible material 14 is being fed to the mandrel 12, the roll packing material 32 is being fed to the mandrel 12 underneath the compressible material 14. As shown in FIG. 14, the compressible material 14 is compressed as it passes between the compression rollers 24 and the mandrel 12.

Figure 15:
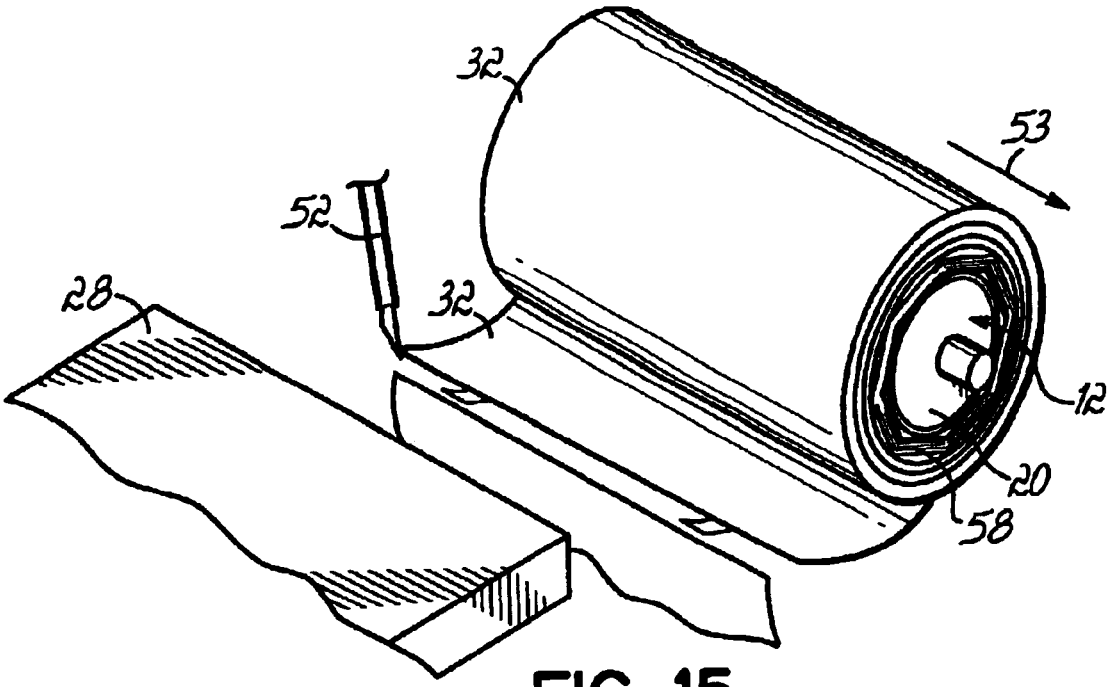
FIG. 15 is a perspective view of the stop of cutting the roll packing material to form a roll of the desired size.

Once the desired roll size is achieved, the compressible material 14 is no longer fed into the nip 26. Although the compressible material 14 is no longer being fed to the mandrel 12, the roll packing material 32 may be being fed to the mandrel 12 at least one revolution around the mandrel. As shown in FIG. 15, the roll packing material 32 is cut with a knife or other suitable apparatus 52 and secured in order to contain the compressible material 14. The finished roll 54 is taken off the mandrel 12 as designated by arrow 53 in a manner such as that disclosed in U.S. patent application Ser. No. 10/066,905 once the cleats 22 of the mandrel 12 are moved to the collapsed position shown in FIG. 9B. However, the finished roll 54 may be removed from the mandrel 12 in any manner.

While the present invention has been illustrated by the description of several preferred embodiments thereof, and while each embodiment has been described in considerable detail, it is not intended to restrict or in any way limit the scope of the appended claims to such detail. For example, the sleeve or core of the roll may be formed of any suitable material. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A method of roll packing a compressible material in a roll, the method comprising the steps of:

providing a mandrel having a rotational axis;

forming a core around the mandrel by wrapping corrugated material around the mandrel and securing the corrugated material to itself;

feeding a compressible material to the mandrel;

rotating the mandrel to wind the compressible material onto the mandrel to form a roll of compressed material; and removing the roll of compressed material including the core from the mandrel.

2. The method of claim 1 further comprising wrapping roll packing material around the mandrel.

3. The method of claim 1 wherein the corrugated material is oriented such that the corrugations of the corrugated material are perpendicular to the rotational axis of the mandrel.

4. A method of roll packing a compressible material in a roll, the method comprising the steps of:

providing a mandrel having a rotational axis;

wrapping roll packing material around the mandrel by rotating the mandrel;

wrapping a sheet of stiffening material around the mandrel;

securing the stiffening material to itself;

feeding a compressible material to the mandrel;

rotating the mandrel to wind the compressible material onto the mandrel to form a roll of compressed material; and removing the roll of compressed material from the mandrel.

5. The method of claim 4 further comprising providing a compression roller proximate the mandrel for compressing the compressible material.

6. The method of claim 4 further comprising feeding a packing material to the compressible material while feeding the compressible material to the mandrel.

7. The method of claim 4 further comprising providing a feed table upstream of the mandrel.

8. The method of claim 4 wherein the stiffening material is adhesively secured to itself.

9. The method of claim 4 wherein wrapping a sheet of stiffening material around the mandrel comprises wrapping a sheet of corrugated material around the mandrel.

10. The method of claim 9 wherein the corrugated material is oriented such that the corrugations of the corrugated material are perpendicular to the rotational axis of the mandrel.

11. A method of roll packing a compressible material in a roll, the method comprising the steps of:

providing a mandrel having a rotational axis;

securing roll packing material to the mandrel;

rotating the mandrel to wind the roll packing material onto the mandrel;

feeding corrugated material to the mandrel;

rotating the mandrel to wind the corrugated material around the mandrel;

securing the corrugated material to itself, the corrugated material being wrapped around the mandrel;

feeding a compressible material to the mandrel;

rotating the mandrel to wind the compressible material onto the mandrel to form a roll of compressed material outside the corrugated material; and removing the roll of compressed material from the mandrel.

12. The method of claim 11 further including the step of securing the roll packing material, prior to removal of the roll of compressed material from the mandrel, to prevent unrolling.

13. A method of roll packing a compressible material in a roll, the method comprising the steps of:

providing a mandrel having a rotational axis;

feeding corrugated material to the mandrel;

rotating the mandrel to wind the corrugated material around the mandrel;

securing the corrugated material to itself, the corrugated material being wrapped around the mandrel;

feeding a compressible material to the mandrel;

rotating the mandrel to wind the compressible material onto the mandrel to form a roll of compressed material outside the corrugated material; and removing the roll of compressed material from the mandrel.

14. The method of claim 13 further comprising the steps of:

feeding roll packing material to the mandrel with the compressible material such that as the mandrel is rotated, the roll packing material is wound onto the mandrel with the compressible material.

15. The method of claim 13 wherein said corrugated material is fed to the mandrel with the corrugations of the corrugated material extending perpendicular to the horizontal axis of the mandrel.

16. A method of roll packing a compressible material in a roll, the method comprising the steps of:

providing a mandrel having a rotational axis;

securing roll packing material to the mandrel;

applying adhesive to the roll packing material as the mandrel is rotated, the adhesive being sandwiched between layers of roll packing material;

stopping the application of adhesive to the roll packing material;

allowing the adhesive to dry, thereby creating a laminated sleeve;

feeding a compressible material to the mandrel;

further rotating the mandrel to wind the compressible material and the roll packing material onto the laminated sleeve to form a roll of compressed material;

stopping rotation of the mandrel;

cutting the roll packing material; and removed the roll of compressed material including the laminated sleeve from the mandrel.

17. A method of roll packing a compressible material in a roll, the method comprising the steps of:

providing a mandrel having a rotational axis;

securing roll packing material to the mandrel;

begin rotating the mandrel;

feeding roll packing material to the mandrel as the mandrel is rotating, thereby wrapping the roll packing material around the mandrel;

applying adhesive to the roll packing material before the roll packing material is wrapped around the mandrel;

stopping the application of adhesive to the roll packing material;

allowing the adhesive to dry to create a laminated sleeve feeding a compressible material to the mandrel;

further rotating the mandrel to wind the compressible material onto the laminated sleeve along with the roll packing material to form a roll of compressed material; and removing the roll of compressed material including the laminated sleeve from the mandrel.

18. A method of roll packing a compressible material in a roll, the method comprising the steps of:

providing a mandrel having a rotational axis and a plurality of cleats movable between an expanded position and a collapsed position;

forming a core around the mandrel with the cleats in the expanded position;

feeding a compressible material to the mandrel with the cleats in the expanded position;

rotating the mandrel to wind the compressible material onto the core to form a roll of compressed material;

moving the cleats of the mandrel to the collapsed position; and removing the roll of compressed material including the core from the mandrel.

19. The method of claim 18 wherein forming the core around the mandrel comprises wrapping a sheet of stiffening material around the mandrel and securing the sheet to itself.

* * * * *